United States Patent [19]

Lykins

[11] Patent Number: 4,538,651

[45] Date of Patent: Sep. 3, 1985

[54] INTERLOCKED, CLEAN LOADING TONER CARTRIDGE

[75] Inventor: Larry W. Lykins, Longmont, Colo.

[73] Assignee: International Business Machines Corporation, Armonk, N.Y.

[21] Appl. No.: 514,997

[22] Filed: Jul. 18, 1983

[51] Int. Cl.[3] ..... B65B 1/04

[52] U.S. Cl. ..... 141/1; 141/89; 141/98; 141/311 R; 141/367; 141/364; 206/816; 53/396; 220/359; 222/160; 222/DIG. 1; 312/330 R; 312/349; 312/350

[58] Field of Search ..... 141/367, 350, 368, 325-327, 141/369-381, 364, 311 R, 89, 1-12, 98; 222/160, 329, 540, 541, 542, DIG. 1; 206/816; 312/330 R, 349, 350; 211/153; 220/359; 53/396

[56] References Cited

U.S. PATENT DOCUMENTS 1,990,926 2/1935 Bergmann ..... 141/367

4,062,385 12/1977 Katusha et al. ..... 141/89

*Primary Examiner*—Houston S. Bell, Jr.

*Attorney, Agent, or Firm*—Francis A. Sirr

[57] ABSTRACT

Two different type toners are packaged in a cartridge having reversible parts. Reversal of the parts, as the two different toners are packaged, insures use of the correct toner in the correct one of two different electrophotographic reproduction devices.

13 Claims, 3 Drawing Figures

INTERLOCKED, CLEAN LOADING TONER CARTRIDGE

FIELD OF THE INVENTION

The present invention relates to the field of electrophotographic reproduction, and to the periodic replenishment of xerographic toner to the developer station of such a reproduction device.

BACKGROUND OF THE INVENTION

The present invention relates to a toner cartridge construction and arrangement which bottom-dumps, under the force of gravity, into the toner replenisher mechanism of a developer station; the bottom of the cartridge being sealed by a folded-back-upon-itself, traveling-fold seal.

Traveling-fold seals have been used in prior art toner cartridges, and U.S. Pat. Nos. 3,999,654 and 4,062,385 are exemplary.

U.S. Pat. 3,999,654 (incorporated herein by reference) teaches forming the traveling-fold seal (22) from an elongated, flexible, smooth-surfaced seal-strip or tongue, using material of the type which is also preferred for use in the present invention. This seal-strip is made of a polyethylene fibrous sheet comprising a multiplicity of randomly oriented and bonded polyethylene fibers, the sheet having nondirectional shear strength or tearing characteristics. The brand is TYVEK, by E. I. DuPont de Nemours & Co.

U.S. Pat. 4,062,385 (incorporated herein by reference) teaches the use of a slide-cover (4) which protects the traveling-fold seal (3) during storage, etc. This patent also recognizes that removal of the traveling-fold seal may, at times, cause toner to be drawn out of the cartridge, on the surface of the seal. To prevent toner contamination of the surrounding area, this patent teaches the use of a construction and arrangement whereby the aforesaid slide-cover, which is first displaced to the side of the toner cartridge (FIG. 3), includes a wiper-seal (5) which wipes the side of the seal-strip on which toner had been resting prior to removal of the seal-strip.

Also of interest is the IBM TECHNICAL DISCLOSURE BULLETIN of January 1980, at pages 3112–3113, which describes the manner in which toner cartridges of this general type can be interlocked, so as to insure that a specific toner can be used only in the reproduction device for which it was intended.

SUMMARY OF THE INVENTION

The present invention relates to an improved toner cartridge of the aforesaid types where, according to the present invention, means are provided to insure clean-unload of the cartridge; where a slide-cover is provided to protect and strengthen the cartridge's traveling-fold seal during storage, etc.; and where, during manufacture, 180°-rotation of the traveling-fold seal, prior to attachment to the body of the toner cartridge, provides an interlock scheme which insures use of two different toners with the proper one of two different reproduction devices.

In the xerographic art it is often desirable to provide different toners for use in different reproduction devices. Hereinafter, one toner will be called toner "A", for use in device "A"; and another toner will be called toner "B", for use in device "B". The present invention provides one set of container 10, seal strip 11 and slide 12 which will accommodate both types of toner, in a construction and arrangement which prevents usage of the wrong toner in a reproduction device.

The foregoing and other features and advantages of the invention will be apparent from the following more particular description of a preferred embodiment of the invention, as illustrated in the accompanying drawing.

DESCRIPTION OF THE PREFERRED EMBODIMENT

Figure 1:
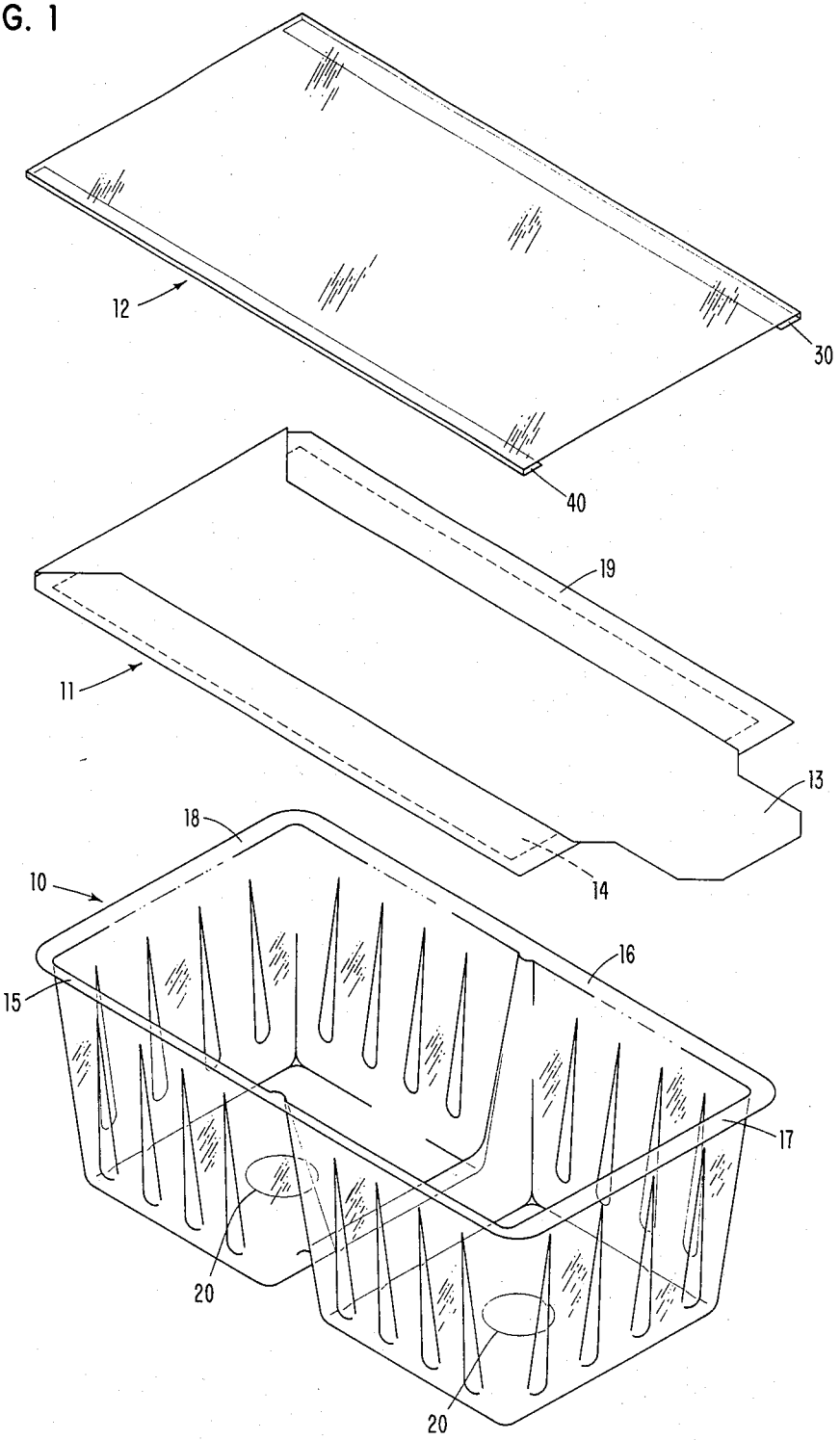
FIG. 1 is an exploded view of the three elements making up a toner cartridge (minus the toner) according to the present invention, and showing the traveling-fold seal strip as it is oriented when the cartridge is to contain toner "A", to be used in reproduction device "A"; and FIG'S. 2 and 3 are views of the front, operator-accessible, side of the replenisher guides of reproduction devices "A" and "B", respectively.

The cartridge of the present invention comprises a generally parallelepiped-shaped container 10, a traveling-fold seal strip 11, and a protective/strengthening slide 12. This cartridge may hold about eight pounds of toner.

Container 10 is formed of polyethylene terephthalate, about 0.030 inch thick. Slide 12 is formed of polyethylene terephthalate about 0.012 inch thick. Strip 11 is a paper, cloth-like material known as TYVEK (a polyethylene fibrous sheet formed of randomly oriented, bonded polyethylene fibers, and possessing non-directional shear strength).

Strip 11 includes a handle portion 13 which must be located at the front of the xerographic device, once the cartridge is located and clamped onto the reproduction device's toner dispenser (partially shown in FIG'S. 2 and 3). When cartridge 10 is clamped to the toner dispenser (by clamp means not shown), the rectangular opening in container 10 (which is shown facing up in FIG. 1) actually faces down. Strip 11 is then removed by manually pulling on handle portion 13.

The portion of strip 11 that faces the toner is covered by a thin, low-surface-energy layer 14, such as a lamination of nylon 0.003 inch thick. Other acceptable low-surface-energy materials are nonbiaxially oriented polyethylene terephthalate. Layer 14 does not have a high affinity for toner, and thus very little toner is carried out of the cartridge during the process of removing strip 11.

The boundary of the housing's dump opening includes a continuous flange 15, 16, 17, 18 which encircles this opening. Surfaces 15, 16, 17, 18 lie in a common plane. The corresponding boundary area 19 of strip 11 is glued or otherwise sealed to flange 15, 16, 17, 18, using a releasable, peelable adhesive. An exemplary sealing process utilizes a commercially available adhesive, a pressure of 50 psi, and a temperature in the range of 230° to 250° F., which are maintained for from two to five seconds.

Container 10 includes two unequal-width flange portions 15 and 16, i.e. flange portion 16 is wider than flange portion 15. These two flange portions mate with unequal-depth mounting channels formed in the reproduction device's toner dispenser, as illustrated in FIG'S. 2 and 3. The individual toner dispensers of the two aforesaid electrophotographic devices "A" and "B" are formed with channels 110, 110' and 120, 120' which accept wide-flange 16 and narrow-flange 15, respectively. If one attempts to position the wrong toner cartridge on a dispenser, flanges 15 and 16 will not properly mate with the unequal-depth mounting channels 110, 110'–120, 120'. Furthermore, the cartridge's handle portion 13 is not visible for manual actuation if one attempts to load the wrong cartridge; but rather, handle portion 13 faces the rear of the electrophotographic device where it cannot be manually removed.

Figure 3:
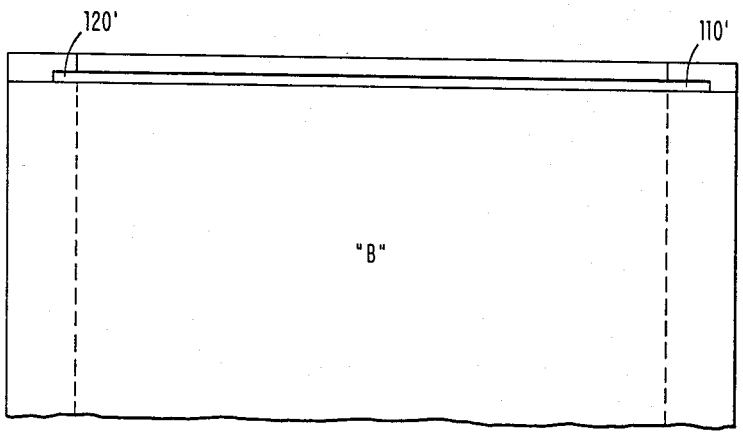

For example, with electrophotographic device "A" (FIG. 3), wide flange 16 must be located on the right (while viewing the reproduction device from the front).

Figure 2:
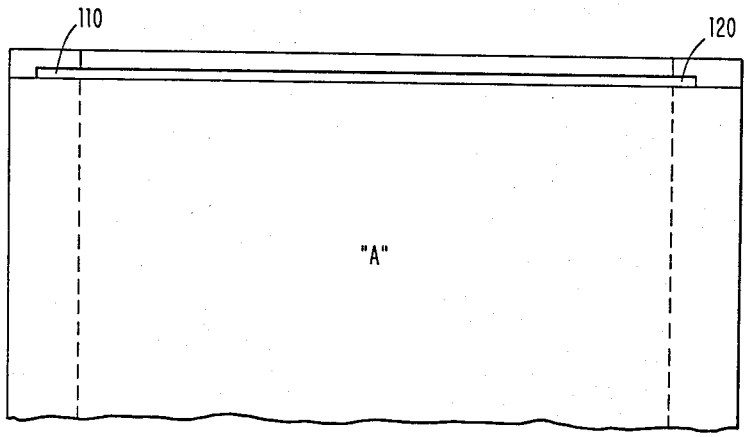

All cartridges which are to contain toner "A" (usable only in device "A") are made by laminating, gluing or sealing strip 11 to container 10 as shown in FIG. 1. Thus, handle portion 13 is visible when wide flange 16 is on the left side (FIG. 2), as strip 11 faces down. In order to make a cartridge for toner "B" (usable only in device "B"), it is merely necessary to turn either strip 11 or container 10 end-for-end, 180°, prior to laminating strip 11 to container 10. Since the two electrophotographic devices "A" and "B" will accept the cartridge in only one positional attitude, as aforesaid, and since handle portion 13 is accessible only when the proper cartridge (i.e., and the proper toner) has been located on the toner dispenser, use of the wrong toner in a reproduction device is prevented.

In the case of both type cartridges, after strip 11 is glued in place, as aforesaid, slide 12 is slipped over flanges 15 and 16 of container 10. As shown in FIG. 1, slide 12 includes folded portions 30 and 40 which mate in sliding fashion to flanges 15 and 16. The container at this time does not contain toner.

Container 10 includes two openings 20 which are now used to fill the container with the correct toner (of type "A" or "B", as aforesaid). Openings 20 are thereafter covered with a material such as an adhesive tape.

Just prior to installing the filled cartridge on a device's toner dispenser (FIG. 2 or 3), slide 12 is removed.

The toner cartridge of this invention is selectively fabricated to contain one of two different xerographic toners, arbitrarily called toner "A" and toner "B". The composition of these toners is not critical to the present invention. As those skilled in the art will appreciate, the state of the electrophotographic reproduction art has progressed to the point where a unique toner (chemical composition, particle size, etc.) can have a synergistic effect with a particular reproduction device. More specifically, a particular toner is necessary in a particular device, in order to produce the copy quality, yield, cleanliness, etc. now demanded by the marketplace.

While the invention has been particularly shown and described with reference to a preferred embodiment thereof, it will be understood by those skilled in the art that various changes in form and details may be made therein without departing from the spirit and scope of the invention.

What is claimed is:

1. A traveling-fold sealed toner cartridge selectively containing toner "A" or toner "B", for use with reproduction devices "A" or "B", respectively, comprising:

a cartridge housing having a first end wall and a second oppositely disposed end wall, having interlock means insuring use of the proper toner with the proper reproduction device such that said first end wall faces a given direction when toner "A" is mounted on reproduction device "A", and said second end wall faces said given direction when toner "B" is mounted on reproduction device "B", and having an opening through which toner exits the housing; and a removable traveling-fold seal strip which includes a folded-back handle portion to facilitate removal of the seal strip, said seal strip being capable of closing said housing opening in one of two different 180° rotated positions relative said interlock means and said end walls, such that said handle portion is exposed for seal removal only when a toner "A" cartridge is mounted on reproduction device "A", and vice versa.

2. The toner cartridge of claim 1 wherein said bottom-disposed opening is rectangular in shape, and wherein said traveling-fold seal is of a complementary shape.

3. The toner cartridge of claim 1 wherein said opening is bounded by a flange occupying a given plane, and wherein the boundary of said seal strip is sealed to said flange by a peelable adhesive.

4. The toner cartridge of claim 3 wherein said folded-back handle portion is of reduced width relative to that of said sealed portion.

5. The toner cartridge of claim 3 wherein said interlock means comprises two oppositely disposed portions of said flange which are of unequal width, and which extend from one end wall to the other.

6. The toner cartridge of claim 1 wherein said seal strip includes a layer of low surface energy material defining an inner wall of said cartridge.

7. The toner cartridge of claim 3 including a protective slide removably and slidably mounted over said flange in a manner to strengthen said seal strip.

8. A method for fabricating a toner replenishing system which selectively contains either toner "A" or toner "B", comprising:

providing a box-shaped housing, including a toner-filling opening, and a toner-dump opening;

providing side-disposed interlock means on said housing, adapted to cooperate with an electrophotographic device with which the selected toner is to be used;

providing a traveling-fold seal including a manual handle portion, having symmetry to said toner-dump opening; and sealing said toner-dump opening with said seal oriented in one fashion when said housing is to contain toner "A", and sealing said toner-dump opening with said seal oriented in a 180° rotated fashion when said housing is to contain toner "B", to thereby place the handle portion of said seal at one end of said housing in said one fashion of seal orientation, and to place the handle portion at the other end of said housing in said 180° rotated fashion of seal orientation.

9. The method of claim 8 including the step of utilizing said toner-filling opening to fill said housing with the proper toner after said toner-dump opening has been sealed, followed by the step of sealing said toner-filling opening.

10. The method of claim 9 wherein said seal comprises a first portion adapted to be sealed to the boundary of said housing surrounding said toner-dump opening, and including a second portion which is folded back over said first portion to thereby provide said manual handle portion.

11. The method of claim 10 including the step of providing mating interlock means on electrophotograhic devices "A" and "B", such that said handle portion is accessible only when the proper housing, and thereby the proper toner, is mounted on the electrophotographic devices.

12. The method of claim 10 wherein said seal includes a third portion which is of low surface energy, and forms an internal surface of said box-shaped housing.

13. The method of claim 11 wherein said seal includes a third portion which is of low surface energy, and forms an internal surface of said box-shaped housing.

* * * * *

UNITED STATES PATENT AND TRADEMARK OFFICE

CERTIFICATE OF CORRECTION

PATENT NO. : 4,538,651

DATED : September 3, 1985

INVENTOR(S) : Phillip D. Ballard et al.

It is certified that error appears in the above—identified patent and that said Letters Patent is hereby corrected as shown below:

On the cover sheet, the second printed line, delete "Lykins" and insert --Ballard et al.--

On the cover sheet, left side column by [75] should read:
--Inventors: Phillip D. Ballard, Longmont; Leon C. Brown, Boulder; Paul J. Josephson, Longmont; Larry W. Lykins, Longmont; all of Colorado--

Signed and Sealed this

*Twenty-seventh* Day of *May 1986*

[SEAL]

*Attest:*

DONALD J. QUIGG

*Attesting Officer* *Commissioner of Patents and Trademarks*